US008511542B2

(12) United States Patent
Pan

(10) Patent No.: US 8,511,542 B2
(45) Date of Patent: Aug. 20, 2013

(54) AUTOMATED TELLER MACHINE AND VOICE PROMPT METHOD THEREOF

(75) Inventor: An-An Pan, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 155 days.

(21) Appl. No.: 13/285,023

(22) Filed: Oct. 31, 2011

(65) Prior Publication Data

US 2013/0048713 A1 Feb. 28, 2013

(30) Foreign Application Priority Data

Aug. 25, 2011 (CN) ..... 2011 1 0246213

(51) Int. Cl.
*G07D 11/00* (2006.01)

(52) U.S. Cl.
USPC ..... 235/379; 235/383

(58) Field of Classification Search
USPC ..... 235/379, 380, 383, 385
See application file for complete search history.

(56) References Cited

U.S. PATENT DOCUMENTS 7,866,544 B1 * 1/2011 Block et al. ..... 235/379
8,261,976 B1 * 9/2012 Block et al. ..... 235/379
8,376,221 B1 * 2/2013 Ramachandran et al. .... 235/379

* cited by examiner

*Primary Examiner* — Daniel St Cyr
(74) *Attorney, Agent, or Firm* — Altis Law Gorup, Inc.

(57) ABSTRACT

A voice prompt method includes obtaining an image of a user and storing the obtained image as a characteristic image when users successfully log onto an automated teller machine; taking photographs of the location surrounding the automated teller machine at predetermined time intervals to obtain real-time images; judging whether the person of the characteristic image is the same as the person in the real-time image; detecting whether the distance between the user and the automated teller machine is larger than a predetermined value if the person in the two images is judged to be the same; and generating a voice prompt to remind the user not to forget to remove his/her bank card if the distance between the user and the automated teller machine becomes larger than a predetermined value. An automated teller machine is also provided.

13 Claims, 2 Drawing Sheets

AUTOMATED TELLER MACHINE AND VOICE PROMPT METHOD THEREOF

BACKGROUND

1. Technical Field

The present disclosure relates to automated teller machines, and more particularly to an automated teller machine having a function of voice prompting.

2. Description of Related Art

A common type of automated banking machine used by consumers is an automated teller machine ("ATM"), and ATMs are ubiquitous. ATMs enable customers to carry out banking transactions, such as the withdrawal of cash, the making of deposits, and the transfer of funds between accounts. Generally, a bank card is needed to be inserted into the ATM to allow the customers to carry out banking transactions. However, customers sometimes forget to remove the bank card from the ATMs after finishing a transaction, which may result in the bank card being lost or being retained by the ATMs.

Therefore, there is room for improvement in the art.

BRIEF DESCRIPTION OF THE DRAWINGS

The components of the drawings are not necessarily drawn to scale, the emphasis instead being placed upon clearly illustrating the principles of the embodiment. Moreover, in the drawings, like reference numerals designate corresponding parts throughout the views.

DETAILED DESCRIPTION

Embodiments of the present disclosure will now be described in detail with reference to the drawings.

Figure 1:
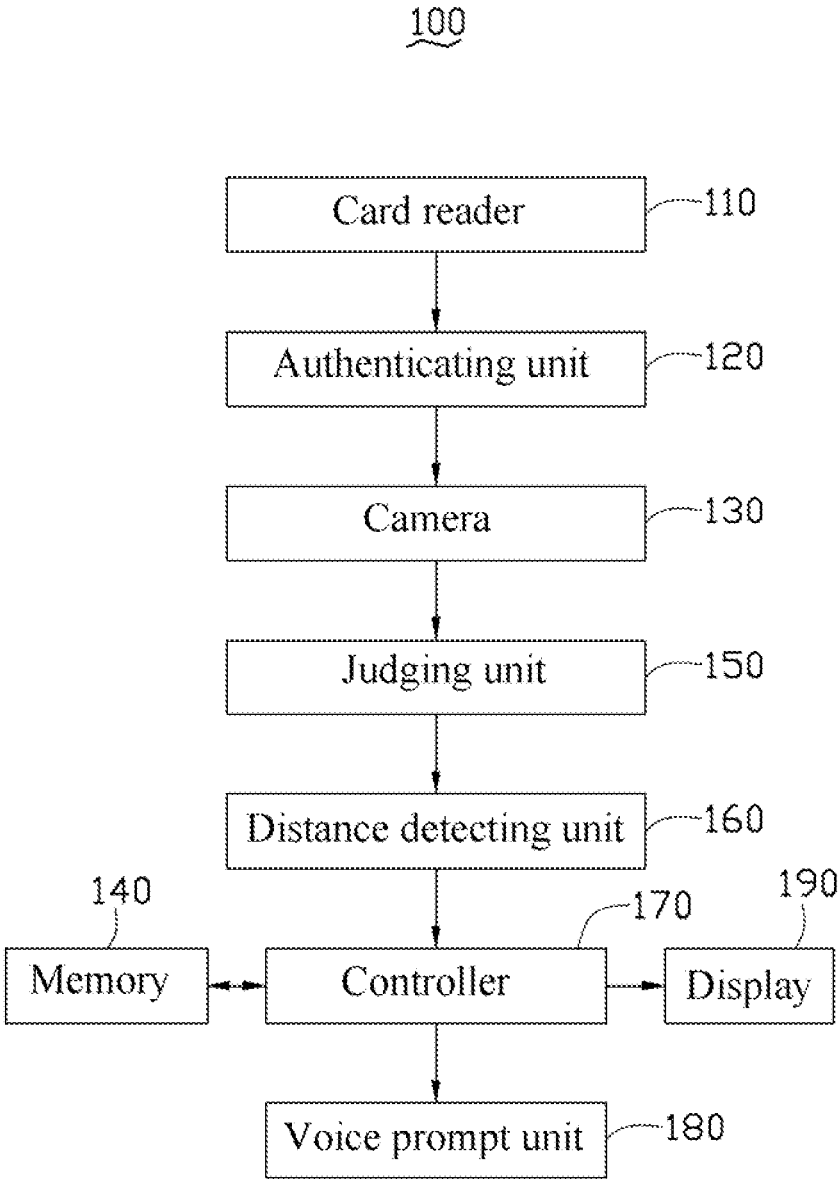
FIG. 1 is a block diagram of an automated teller machine according to an embodiment.

Referring to FIG. 1, an automated teller machine (ATM) 100 according to an embodiment is illustrated. The ATM 100 is capable of reminding users to remove a bank card after finishing a transaction. The ATM 100 includes a card reader 110, an authenticating unit 120 for authenticating users, a camera 130, a judging unit 150, a distance detecting unit 160, a controller 170 and a voice prompt unit 180. The ATM 100 further includes a memory 140 and a display 190. The display 190 is used for displaying an interface for allowing users to interact with the ATM 100, such that users can carry out banking transactions in the ATM 100.

The card reader 110 is used for reading a user's information in the bank cards which is inserted into the ATM 100, and further for reading the account information stored electronically on the magnetic stripe of the bank card.

The camera 130 obtains an image of a user and stores the obtained image as a characteristic image when the user successfully logs onto the ATM 100, and further takes photographs of the location surrounding the ATM 100 at very short predetermined time intervals to obtain real-time images. The camera 130 has a field of vision arranged to include the whole ATM 100, or at least portions of it, including the card reader 110.

Using (for example) facial recognition technology, the judging unit 150 judges whether the person in the characteristic image is the same as the person in the real-time image and generates a determining signal if the person in the two images is judged to be the same. For example, the judging unit 150 may determine that the characteristic image and the real-time image are the same when any facial feature in the characteristic image can be identified as the same in the face identified in the real-time image. When the person in the characteristic image is judged to be different from the person in the real-time image, the judging unit 150 further generates a transaction-end signal to indicate that an unauthenticated person is within a predetermined proximity of the ATM 100.

The distance detecting unit 160 responds to the determining signal generated by the judging unit 150 and detects whether the distance between the authenticated user and the ATM 100 is larger than a predetermined value, and generates a detecting signal if the distance between the user and the ATM 100 is larger than a predetermined value. When the distance between the user and the ATM 100 is detected to be larger than the predetermined value, a conclusion that the user may be walking away from the ATM is drawn. In some embodiments, the distance detecting unit 160 may use known technologies such as ultrasonic distance detecting technology, or infrared detecting technology, to detect the distance between the user and the ATM 100.

The controller 170 responds to the detecting signal generated by the distance detecting unit 160 and controls the voice prompt unit 180 to generate a voice prompt to remind the user not to forget his/her bank card, and further responds to the transaction-end signal to control the ATM 100 to discontinue the transaction interface and controls the card reader 110 to retain the bank card. Furthermore, when the card is half-way ejected out of the card reader 110 slot and after the detecting signal has being received for a predetermined time, such as ten seconds, the controller 170 may further control the card reader 110 to pull the bank card in from the card reader 110 and then retain it.

The voice prompt unit 180 is used to generate a voice prompt to remind the user to remove the bank card.

Figure 2:
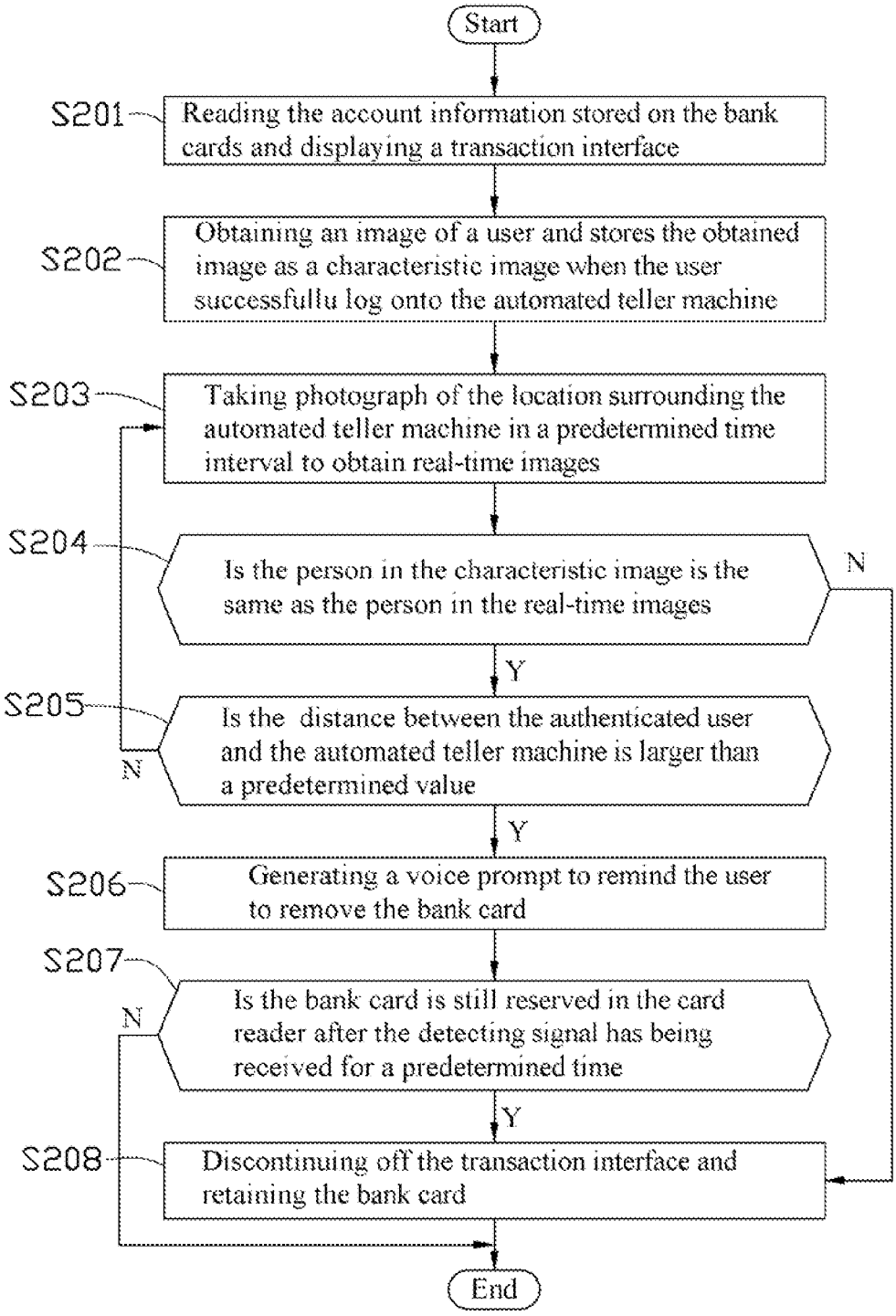
FIG. 2 is a flow chart of a voice prompting method according to an embodiment.

Referring to FIG. 2, the voice prompt method applied in the ATM 100 is provided to avoid a bank card being left in an ATM 100 after a customer has finished his/her transaction(s). The voice prompt method includes the following steps:

In step S201, the card reader 110 reads the account information stored electronically on the magnetic stripe of the bank cards 120 and a transaction interface for allowing users to interact with the ATM 100 is displayed by the display 190.

In step S202, the camera 130 obtains an image of a user and stores the obtained image as a characteristic image after a user has successfully logged onto the ATM 100.

In step S203, the camera 130 further takes photograph(s) of the location surrounding the ATM 100 at predetermined time intervals to obtain real-time image(s).

In step S204, the judging unit 150 judges whether the person in the characteristic image of step S202 is the same as the person in the real-time image(s) of step S203. If the person of the characteristic image is judged to be the same as the person in the real-time image, the procedure goes to step S205; if the persons in the two images are judged to be different, a conclusion that an unauthenticated person may be at the ATM 100 is drawn, and the procedure goes to step S208.

In step S205, the distance detecting unit 160 seeks to continuously detect whether the distance between the authenticated user and the ATM 100 is larger than a predetermined value. If the distance between the authenticated user and the ATM 100 is larger than a predetermined value, a conclusion that the authenticated user is leaving is drawn and the procedure goes to S206; if not, the procedure returns to S203.

In step S206, the controller 170 controls the voice prompt unit 180 to generate a voice prompt requesting the user to remove the bank card.

In step S207, the controller 170 further determines after a predetermined period of time if the bank card is still half-way ejected out in the card reader 110 slot after the detecting signal has being received. If the controller 170 determines that the bank card is still half-way ejected out in the card reader 110 slot, the procedure goes to S208. If it is not, the procedure ends.

In step S208, the controller 170 controls the display 190 to discontinue the transaction interface and controls the card reader 110 to pull in and retain the bank card against any customer, to prevent the band card being lost or used illegally.

With the assistance of the ATM 100 and the voice prompt method applied therein, a voice prompt will be generated to remind the user not to forget his/her bank card before the user actually leaves the ATM 100.

While various exemplary and preferred embodiments have been described, it is to be understood that the disclosure is not limited thereto. On the contrary, various modifications and similar arrangements (as would be apparent to those skilled in the art) are intended to also be covered. Therefore, the scope of the appended claims should be accorded the broadest interpretation so as to encompass all such modifications and similar arrangements.

What is claimed is:

1. An automated teller machine capable of reminding users to remove a bank card after finishing a transaction, comprising:

a card reader for reading the account information stored on the bank cards after users successfully log onto the automated teller machine;

a voice prompt used for generating voice prompting;

a camera used for obtaining an image of a user and storing the obtained image as a characteristic image when the user successfully log onto the automated teller machine, the camera further used for taking photograph of the location surrounding the automated teller machine in a predetermined time interval to obtain real-time images;

a judging unit used for judging whether the person in the characteristic image is the same as the person in the real-time image and generates a determining signal if the person in the characteristic image is judged to be the same as the person in the real-time image;

a distance detecting unit responding to the determining signal and used for detecting whether the distance between the user and the automated teller machine is larger than a predetermined value, and further generating a detecting signal if the distance between the user and the automated teller machine is larger than a predetermined value; and a controller responding to the detecting signal and used for controlling the voice prompt unit to generate voice prompt to remind users to remove a bank card.

2. The automated teller machine of claim 1, further comprising a display for displaying a transaction interface when users successfully log onto the automated teller machine.

3. The automated teller machine of claim 2, wherein the judging unit further generates a transaction-end signal if the person in the characteristic image is judged to be different from the person in the real-time image; the controller responds to the transaction-end signal and controls the display to log off the transaction interface, and further controls the card reader to retain the bank card.

4. The automated teller machine of claim 1, further comprising a memory for storing the characteristic image and the predetermined value.

5. The automated teller machine of claim 1, wherein the controller further determines after a predetermined period of time if the bank card is partially ejected out of the card reader slot after the detecting signal has being received, and controls the card reader to retain the bank card if the bank card is determined to be still partially ejected out of the card reader.

6. The automated teller machine of claim 1, wherein the judging unit compares the facial feature identified in the characteristic image and the real-time images to determine whether the person in the characteristic image and the person in the real time are the same.

7. The automated teller machine of claim 1, wherein the distance detecting unit detects the distance between the user and the automated teller machine by using ultrasonic distance detecting technology, facial recognition technology, or infrared detecting technology.

8. A voice prompt method for reminding users to remove a bank card from an automated teller machine after finishing a transaction, the voice prompt method comprising:

reading the account information stored on the bank card after users successfully log onto the automated teller machine;

obtaining an image of a user and storing the obtained image as a characteristic image when the user successfully logs on to the automated teller machine;

taking photograph of the location surrounding the automated teller machine in a predetermined time interval to obtain real-time images;

judging whether the person in the characteristic image is the same as the person in the real-time images;

detecting whether the distance between the user and the automated teller machine is larger than a predetermined value if the person in the characteristic image is judged to be the same as the person in the real-time image; and generating a voice prompt to prevent the user from forgetting to remove the bank card if the distance between the user and the automated teller machine is larger than a predetermined value.

9. The voice prompt method as claimed in claim 8, wherein the voice prompt method further comprises the step of displaying a transaction interface when users successfully log on the automated teller machine.

10. The voice prompt method as claimed in claim 9, wherein the voice prompt method further comprises the step of logging off the transaction interface and retaining the bank card if the person in the characteristic image is judged to be different from the person in the real-time images.

11. The voice prompt method as claimed in claim 8, wherein the voice prompt method further comprises the step of:

determining after a predetermined period of time if the bank card is partially ejected out of the card reader slot after the detecting signal has being received; and retaining the bank card if the bank card is determined to be still partially ejected out of the automated teller machine.

12. The voice prompt method as claimed in claim 8, wherein the facial feature identified in the characteristic image and the real-time images is compared to determine whether the person in the characteristic image and the person in the real-time images are the same.

13. The voice prompt method as claimed in claim 8, wherein the distance between the user and the automated teller machine is obtained by using ultrasonic distance detecting technology, facial recognition technology, or infrared detecting technology.

* * * * *